United States Patent [19]

Shiraishi

[11] Patent Number: 5,013,173

[45] Date of Patent: May 7, 1991

[54] CONTAINER FOR A COSMETIC LIQUID

[76] Inventor: Katsumune Shiraishi, 3-54-5, Sendagaya, Shibuya-ku, Tokyo, Japan

[21] Appl. No.: 409,778

[22] Filed: Sep. 20, 1989

[30] Foreign Application Priority Data

Apr. 4, 1989 [JP] Japan ..... 1-39822[U]

[51] Int. Cl.[5] ..... B05C 17/00; A45D 34/04

[52] U.S. Cl. ..... 401/202; 401/208

[58] Field of Search ..... 401/202, 261, 262, 266, 401/207, 196, 198, 199, 208, 265

[56] References Cited

U.S. PATENT DOCUMENTS

| | | | |
|---|---|---|---|
| 485,592 | 11/1892 | Truitt | 401/198 |
| 812,087 | 2/1906 | Peterson | 401/208 X |
| 2,314,243 | 3/1943 | Witt | 239/363 X |
| 3,263,265 | 8/1966 | Judson | 401/208 X |
| 3,642,180 | 2/1972 | Lehmann | 239/337 X |
| 4,129,391 | 12/1978 | Gamacher | 401/208 |
| 4,147,441 | 4/1979 | Harrison | 401/208 |
| 4,324,632 | 4/1982 | Stansbury | 239/331 X |
| 4,812,067 | 3/1989 | Brown | 401/196 |

FOREIGN PATENT DOCUMENTS

| | | | |
|---|---|---|---|
| 185930 | 10/1953 | Australia | 230/363 |
| 74717 | 6/1945 | Fed. Rep. of Germany | 239/363 |
| 947526 | 1/1949 | France | 239/355 |
| 101949 | 7/1962 | Netherlands | 401/183 |
| 623404 | 5/1949 | United Kingdom | 239/355 |

*Primary Examiner*—Richard J. Johnson

*Attorney, Agent, or Firm*—Oblon, Spivak, McClelland, Maier & Neustadt

[57] ABSTRACT

A container for a cosmetic liquid comprises a flat, rectangular container body, of the size of a cash card such as a credit card or a bank card, having an inner chamber capable of storing an anti-perspiration liquid agent, a roller attached to an end portion of the container body so as to be rotatable around its longitudinal axis, the roller having a surface layer made of cloth, a conduit for supplying the liquid agent in the inner chamber to said roller, and a cap detachably attached to the container body so as to cover the roller.

3 Claims, 5 Drawing Sheets

CONTAINER FOR A COSMETIC LIQUID

BACKGROUND OF THE INVENTION

1. Field of the Invention

The present invention relates to a container for a cosmetic liquid such as an anti-perspiration agent, a wetting agent, eau de Cologne, a lotion or the like which is applicable to a human body.

2. Discussion of Background

A conventional container for a cosmetic liquid is generally of a form of a bottle.

Although the conventional container for a cosmetic liquid is conveniently used at his or her house, it is inconvenient to carry it for outdoor use, and it can not be easily used for outdoor use.

SUMMARY OF THE INVENTION

It is an object of the present invention to provide a container for a cosmetic liquid which is capable of easily carrying for outdoor use and travel without bulking a pocket, a bag and so on.

In accordance with the present invention, there is provided a container for a cosmetic liquid which comprises a flat, rectangular container body, of the size of a cash card, having an inner chamber capable of storing a cosmetic liquid, a roller attached to an end portion of the container body so as to be rotatable around its longitudinal axis and having at least a surface layer capable of retaining the cosmetic liquid, a conduit for supplying the cosmetic liquid in the inner chamber to the roller provided at the end portion of the container body, and a cap detachably attached to the container body so as to cover the roller.

In accordance with the present invention, there is provided a container for a cosmetic liquid which comprises a flat, rectangular container body, of the size of a cash card, having an inner chamber capable of storing a cosmetic liquid, an applying body attached to an end portion of the container body and being wettable to the cosmetic liquid, a conduit for supplying the cosmetic liquid in the inner chamber to the applying body provided at the end portion of the container body, and a cap detachably attached to the container body so as to cover the applying body.

In accordance with the present invention, there is provided a container for a cosmetic liquid which comprises a flat, rectangular container body, of the size of a cash card, having an inner chamber capable of storing a cosmetic liquid, a roller attached to an end portion of the container body so as to be rotatable around its longitudinal axis and having at least a surface layer capable of retaining the cosmetic liquid, a conduit for supplying the cosmetic liquid in the inner chamber to the roller provided at the end portion of the container body, and a cover slidably attached to the container body so as to cover or expose the roller.

In accordance with the present invention, there is provided a container for a cosmetic liquid which comprises a flat, rectangular container body, of the size of a cash card, having an inner chamber capable of storing a cosmetic liquid, an applying body attached to an end portion of the container body and being wettable to the cosmetic liquid, a conduit for supplying the cosmetic liquid in the inner chamber to the applying body provided at the end portion of the container body, and a cover slidably attached to the container body so as to cover or expose the applying body.

In accordance with the present invention, there is provided a container for a cosmetic liquid which comprises a flat, rectangular container body, of the size of a cash card, a roller attached to an end portion of the container so as to be rotatable around its longitudinal axis and having at least a surface layer capable of retaining the cosmetic liquid, a tank receiving portion formed in the container body, a tank for storing a cosmetic liquid which is detachably fitted to the tank receiving portion, a conduit for supplying the cosmetic liquid in the tank to the roller at the container body, and a cap detachably attached to the container body so as to cover the roller.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
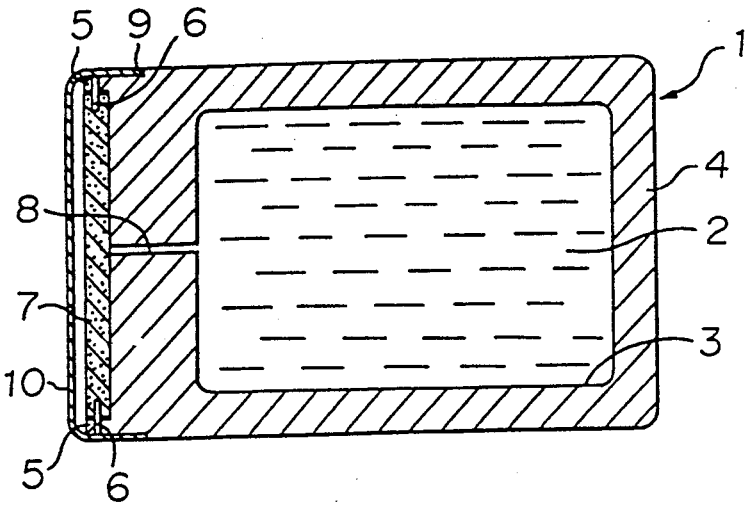
FIG. 1 is a longitudinal cross-sectional view of an embodiment of the container for a cosmetic liquid according to the present invention.
Figure 2:
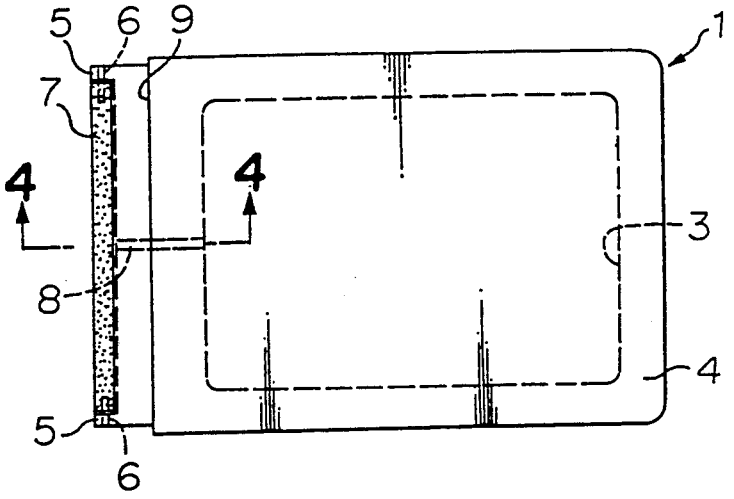
FIG. 2 is a front view of the container for a cosmetic liquid without a cap as shown in FIG. 1.
Figure 4:
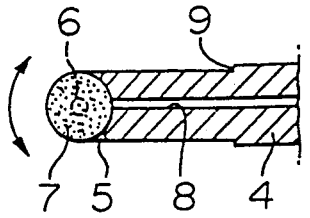
FIG. 4 is an enlarged cross-sectional view taken along a line 4—4 in FIG. 2.
Figure 3:
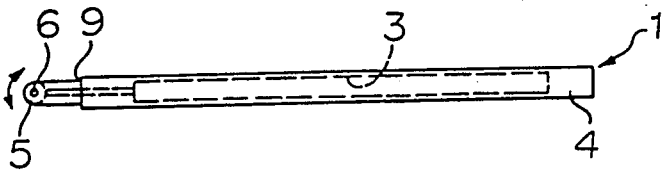
FIG. 3 is a side view of the container for a cosmetic liquid as shown in FIG. 2.

Referring to the drawings, wherein the same reference numerals designate the same or corresponding parts throughout the several views, and more particularly to FIGS. 1 to 4 thereof, there is shown a typical example of the container for a cosmetic liquid of the present invention. In FIGS. 1 to 4, a reference numeral 1 designates a container for storing and dispensing a cosmetic liquid such as an anti-perspiration agent, having a flat, substantially rectangular shape. The container 1 for a cosmetic liquid comprises a container body 4 which is formed to be in a substantially cash-card-like size such as a credit card or a bank card. The length and the width of the container are substantially the same as those of a cash card, but the depth of it is somewhat larger. More specifically, the thickness of the container is within the range of 0.3 to 1.0 cm, the width of the container is within the range of 5.0 to 6.0 cm and the length of the container is within the range of 8.0 to 9.0 cm. Accordingly, the container of the present invention can be stored and carried in a similar manner as a cash card, credit card or bank card. The container body 4 contains a chamber 3 capable of storing an anti-perspiration agent in a liquid form, a pair of bearing plates 5, 5 projecting outwardly from both side portions of an end portion of the container body 4, a roller 7 made of a porous material such as a plastic resinous material capable of retaining and being wettable to the anti-perspiration agent 2, which is rotatably supported between the pair of bearing plates 5, 5 by means of pins 6, a conduit 8 for supplying the anti-perspiration agent in the chamber 3 to the roller 7 provided at the end portion of the container body 4, and a cap 10 detachably attached to a cap-fitting portion 9 formed in the container body 4, so as to cover the outer peripheral portion of the roller 7.

The roller 7 may have a surface layer made of a soft porous material instead of the roller being entirely made of the porous material. In the container for a cosmetic liquid described above, since the roller 7 is rotatably supported by the bearing plates 5 so that the outer circumference of the roller covers and is in contact with an opening of the conduit 8. Accordingly the liquid agent stored in the chamber 3 can easily wet the roller 7.

When the container of the present invention is to be used, the cap 10 is taken off from the container body 4, and the roller 7 is brought into contact with a portion of a human body to be desired for application of the anti-perspiration agent 2 and then, the container body 4 is moved slowly. The movement of the container body 4 causes the rotation of the roller 7 so that the anti-perspiration agent 2 in the roller 7 is transferred to the human body.

When the container is temporarily placed with the roller directed in a direction other than the upward direction, preferably in the downward direction, the anti-perspiration agent 2 in the chamber 3 can be easily and automatically supplied to the roller 7 through the conduit 8. In a case that the container 1 is placed with the roller 7 directed upward, the container 1 becomes usable after the roller 7 is directed downwardly for a moment, whereby the anti-perspiration agent 2 is caused to permeate in the roller.

Figure 5:
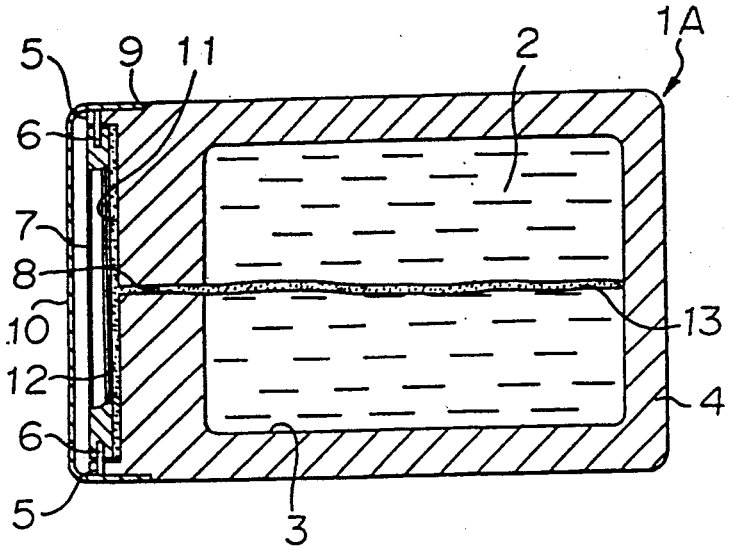
FIG. 5 is a longitudinal cross-sectional view of another embodiment of the container for a cosmetic liquid according to the present invention.
Figure 6:
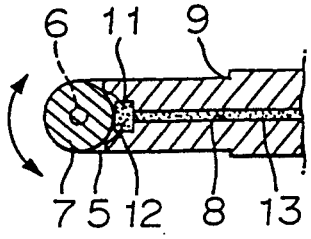
FIG. 6 is an enlarged cross-sectional view partly omitted of the container for a cosmetic liquid as shown in FIG. 5.

FIGS. 5 and 6 show another embodiment of the container 1A for a cosmetic liquid according to the present invention. In FIGS. 5 and 6, the construction of the container 1A is the same as that of the first embodiment except that a groove 11 is formed in the end portion of the container body 4 so as to extend between the bearing plates 5, 5; a retaining material 12 such as cloth, a porous material or the like which is capable of absorbing and retaining the anti-perspiration agent 2 by a capillary action is placed in the groove 11; and a supplying material 13 such as cloth, a porous material or the like which is capable of supplying the anti-perspiration agent in the chamber 3 to the retaining material 12 through the conduit 8 by a capillary action is extended from the conduit 8 to the chamber 3. With such structure, the anti-perspiration agent 2 in the chamber 3 can be always supplied to the roller 7 through the retaining material 12 and the supplying material 13 by the capillary action.

Figure 7:
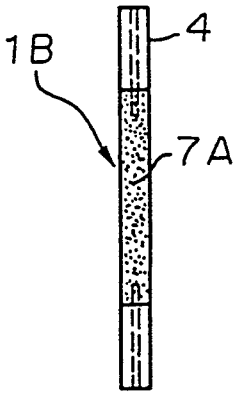
FIG. 7 is a top plane view of another embodiment of the container for a cosmetic liquid according to the present invention.
Figure 8:
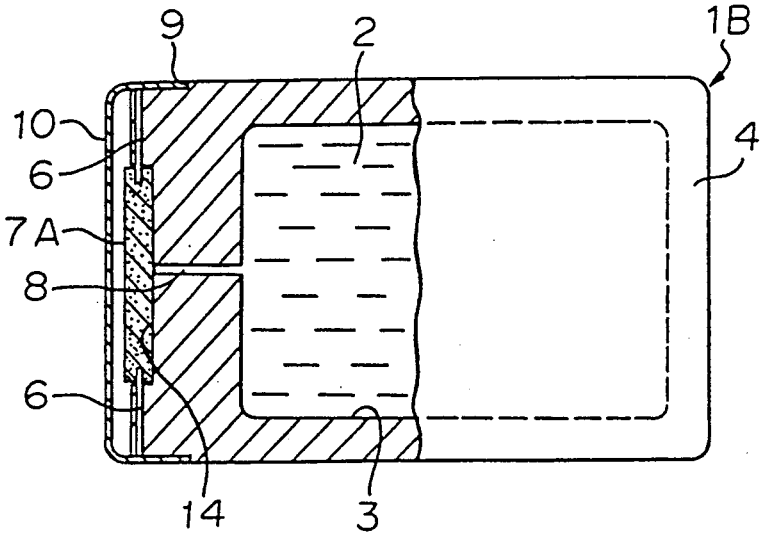
FIG. 8 is a front view partly cross-sectioned of the container for a cosmetic liquid as shown in FIG. 7.

FIGS. 7 and 8 show another embodiment of the container 1B for a cosmetic liquid according to the present invention.

In FIGS. 7 and 8, the construction of the container 1B is the same as that of the first embodiment except that the bearing plates 5, 5 are eliminated and a roller 7A is received in a roller receiving recess 14 formed at the intermediate portion of the end portion of the container body 4. The roller 7A may be made of the same material as the roller 7. The same function and effect can be obtained in the same manner as the first embodiment.

Figure 9:
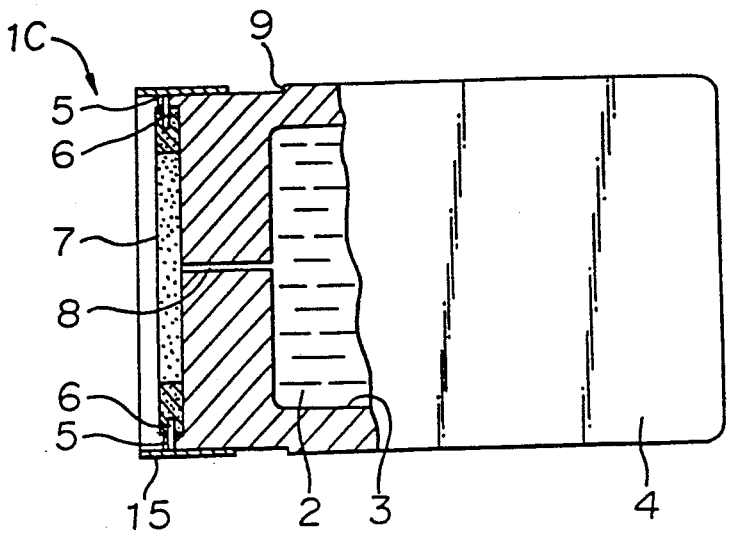
FIG. 9 is a front view partly cross-sectioned of another embodiment of the container for a cosmetic liquid according to the present invention.
Figure 10:
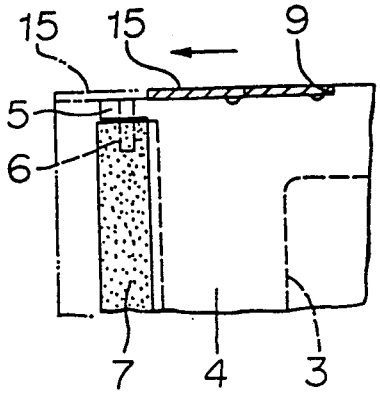
FIG. 10 is an enlarged front view partly crosssectioned and partly omitted of the container as shown in FIG. 9.

FIGS. 9 and 10 show another embodiment of the present invention. The construction of the container 1C as shown in FIGS. 9 and 10 is the same as that of the first embodiment as shown in FIGS. 1 to 4 except for the cap and the cap fitting portion. Namely, a cover 15 is slidably attached to the container body 4 so as to cover and expose the roller 7. For this purpose, the cover 15 is adapted to surround the four side portions of the end portion of the container body 4 where the roller 7 is rotatably supported. The cover 15 has no top portion and is slidably fitted to a fitting portion 9 formed at two opposing side portions or four side portions of the container body 4. Accordingly, when the cover 15 is in a raised position, the roller 7 is hidden by the cover 15, and when the cover is in a lowered position, the roller 7 is exposed so that it is ready to use. In the container 1C of this embodiment, the same function and effect of the first embodiment can be obtained.

Figure 11:
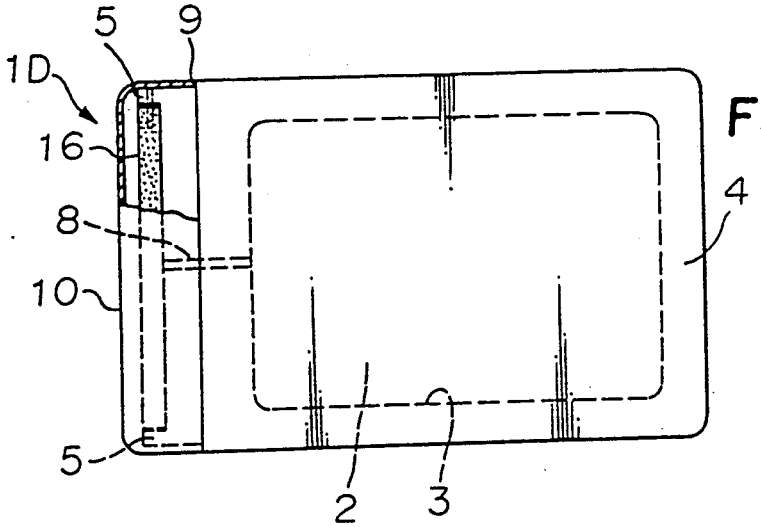
FIG. 11 is a front view partly cross-sectioned of an embodiment of the container for a cosmetic liquid of the present invention.
Figure 12:
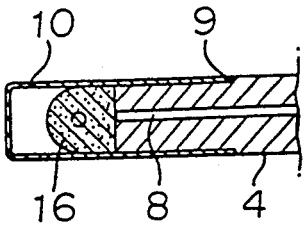
FIG. 12 is an enlarged cross-sectional view partly omitted of the container as in FIG. 11.

FIGS. 11 and 12 show another embodiment of the container 1D of the present invention. The construction of this embodiment is the same as that of the first embodiment as shown in FIGS. 1 to 4 except that an applying body 16 made of woven cloth, non-woven cloth, a porous material or the like which is capable of absorbing and retaining the anti-perspiration agent 2 is firmly attached to the surface of the end portion of the container body 4 where the conduit 8 communicated with the chamber 3 opens. Since the applying body 16 is firmly attached to the container body 4, it is unnecessary to use the pins 6 for rotatably supporting the roller 7 as in the first embodiment, and the bearing plates 5, 5 are used for supporting both ends of the applying body 16. The anti-perspiration agent permeates in the applying body through the conduit 8 and wet the surface of the applying body 16 so that the agent is easily transferred to a portion of a human body.

Figure 13:
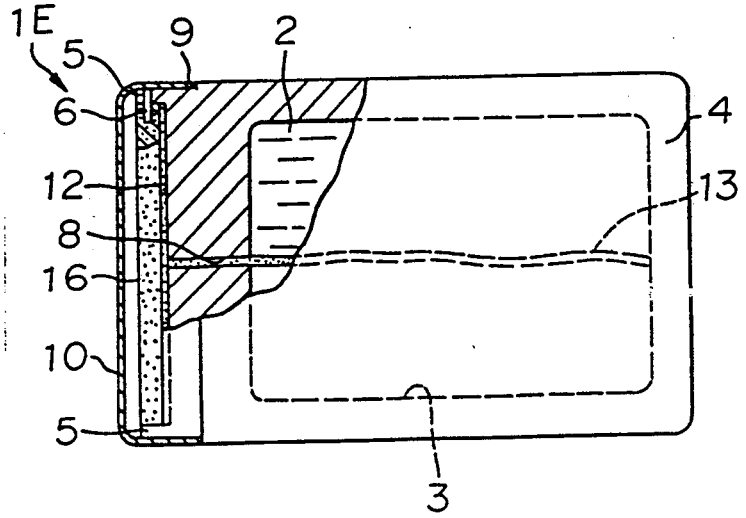
FIG. 13 is a front view partly cross-sectioned of another embodiment of the container for a cosmetic liquid according to the present invention.
Figure 14:
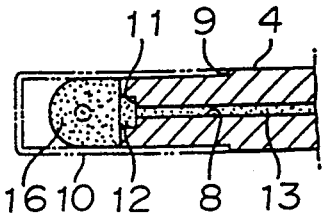
FIG. 14 is an enlarged cross-sectional view partly omitted of the container as shown in FIG. 13.

FIGS. 13 and 14 show another embodiment of the container lE of the present invention. The construction of this embodiment is the same as that shown in FIGS. 5 and 6 except that an applying body 16 made of a porous material capable of absorbing and retaining the anti-perspiration agent 2 is firmly attached to the end portion of the container body 4 instead of using the rotatably supported roller 7 as in FIGS. 5 and 6. The function and effect of the container 1E of this embodiment are the same as that shown in FIGS. 11 and 12.

Figure 15:
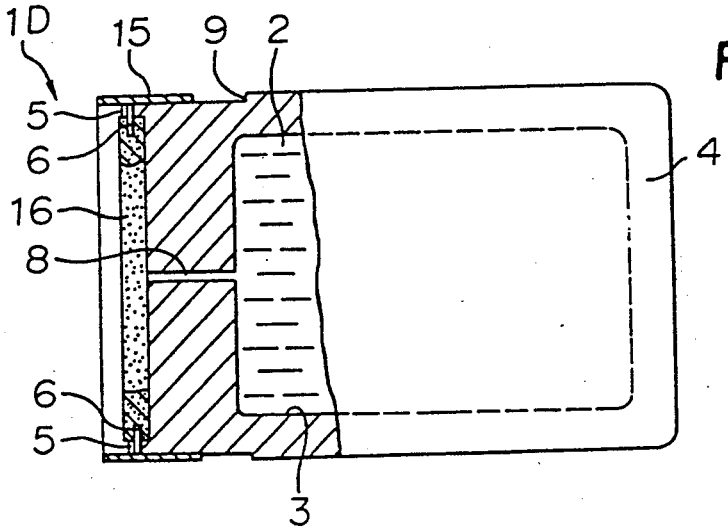
FIG. 15 is a front view partly cross-sectioned of another embodiment of the container for a cosmetic liquid according to the present invention.
Figure 16:
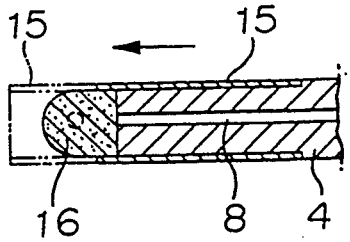
FIG. 16 is an enlarged cross-sectional view partly omitted of FIG. 15.

FIGS. 15 and 16 show another embodiment of the container 1F of the present invention. The construction of this embodiment is the same as that shown in FIGS. 9 and 10 except that the same applying body 16 as used for the embodiment as shown in FIGS. 11 and 12 is placed between the bearing plates 5, 5. In the container 1F for a cosmetic liquid of this embodiment, the same function and effect are obtainable.

Figure 17:
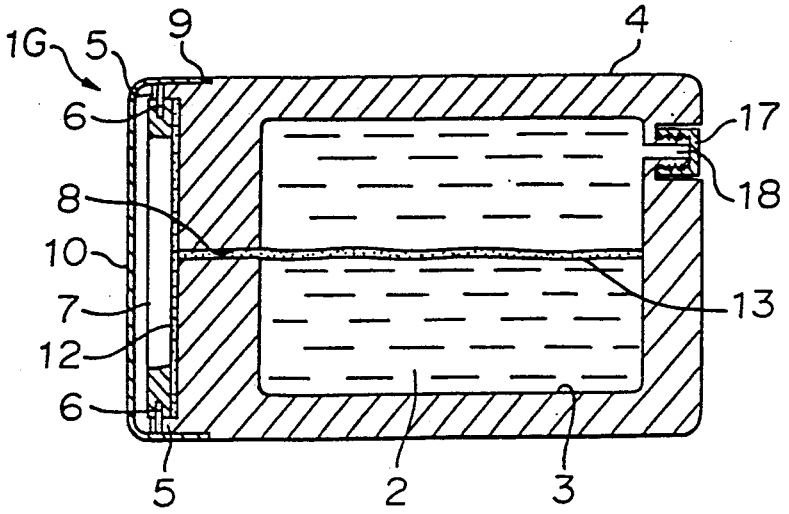
FIG. 17 is a longitudinal cross-sectional view of another embodiment of the container for a cosmetic liquid according to the present invention.
Figure 18:
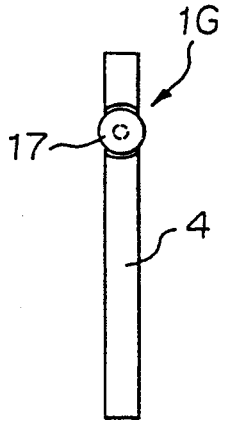
FIG. 18 is a bottom view of the container as shown in FIG. 17.

FIGS. 17 and 18 show another embodiment of the container 1G of the present invention. The construction of this embodiment is the same as that shown in FIGS. 5 and 6 except that an opening 18 with a detachable cap 17 is formed at the other end portion so that the anti-perspiration agent 2 can be filled in the chamber 3 of the container body 4. In the container 1G for a cosmetic liquid of this embodiment, it is repeatedly usable by supplementing the anti-perspiration agent 2 in the chamber 3.

Figure 19:
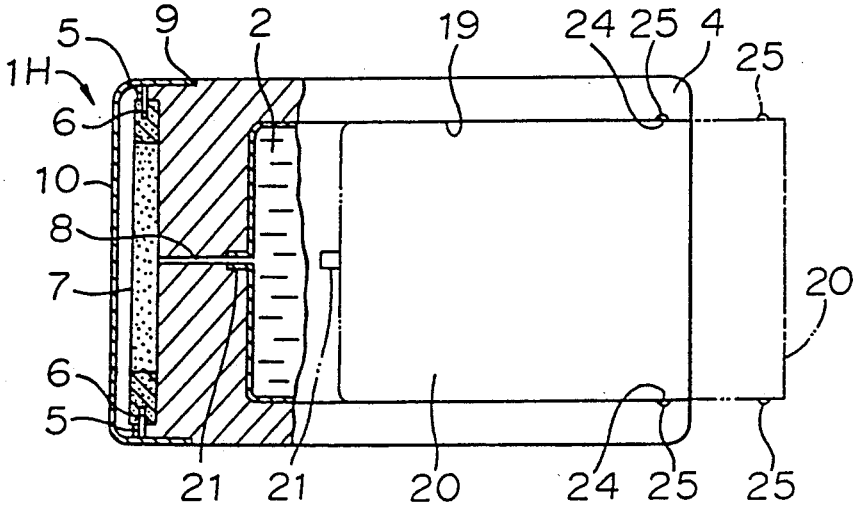
FIG. 19 is a front view partly cross-sectioned of another embodiment of the container for a cosmetic liquid according to the present invention.
Figure 20:
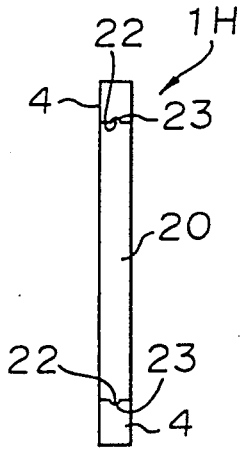
FIG. 20 is a bottom view of the container as shown in FIG. 19.

FIGS. 19 and 20 show another embodiment of the present invention. The construction of this embodiment is the same as that of the first embodiment as shown in FIGS. 1 to 4 except that a tank receiving portion 19 is formed in the container body 4; a tank 20 for storing a cosmetic liquid is detachably fitted to the tank receiving portion 19 so that an opening 21 formed in the tank 20 can be communicated with the conduit 8 when the tank 20 is fitted to the tank receiving portion 19.

In this embodiment, reference numerals 22, 22 designate engaging recesses formed in both inner wall surfaces of the tank receiving portion 19, numerals 23, 23 designate engaging projections formed both side surfaces of the tank 20 so as to engage with each other, numerals 24, 24 designate engaging recesses formed in both inner wall surfaces at the side of opening of the tank receiving portion 19, and numerals 25, 25 designate engaging projections formed in both side surfaces at the lower end portion of the tank 20 to be engaged with the engaging recesses 24, 24.

In the above-mentioned embodiments, description has been made as to the anti-perspiration agent 2 which is to be stored in the chamber 3. However, another cosmetic liquid such as a lotion may be used in the same manner as above.

In the present invention, the following advantages can be obtained.

(1) Due to the size of the container (cash card, credit card), the container for a cosmetic liquid of the present invention can be easily carried without causing a problem of bulking a pocket, a bag or the like and permits outdoor use.

(2) A cosmetic liquid such as an anti-perspiration agent can be easily applied to a human body by simply pushing and moving the container body.

(3) The construction of the container is simple and inexpensive.

Obviously, numerous modifications and variations of the present invention are possible in light of the above teachings. It is therefore to be understood that within the scope of the appended claims, the invention may be practiced otherwise than as specifically described herein.

What is claimed is:

1. A container for a cosmetic liquid which comprises:

a flat, rectangular container body, of the size of a cash card, having an inner chamber capable of storing a cosmetic liquid, an applying body attached to an end portion of said container body and being wettable to the cosmetic liquid;

a conduit for supplying the cosmetic liquid in said inner chamber to said applying body provided at the end portion of said container body; and a cap detachably attached to said container body so as to cover said applying body;

said container having a thickness within a range of 0.3 to 1.0 cm, a width within a range of 5.0 to 6.0 cm and a length within a range of 8.0 to 9.0 cm to allow said container to be stored and carried in a similar manner as a cash card.

2. The container for a cosmetic liquid according to claim 1, wherein said applying body is selected from the group consisting of woven cloth, non-woven cloth and porous materials capable of absorbing and retaining a cosmetic liquid.

3. The container for a cosmetic liquid according to claim 1, wherein said conduit is extended from said inner chamber to open at the contacting surface of said applying body placed at the end portion of the container body.

* * * * *